United States Patent [19]

Perini

[11] Patent Number: 4,748,926

[45] Date of Patent: Jun. 7, 1988

[54] SYSTEM FOR CHANGING THE OUTLINE OF A SAIL BEING WOUND UP TO REDUCE ITS AREA

[76] Inventor: Fabio Perini, P.O. Box 338, Mugnano 55100, Lucca, Italy

[21] Appl. No.: 800,921

[22] Filed: Nov. 22, 1985

[30] Foreign Application Priority Data

Nov. 30, 1984 [IT] Italy ..... 9554 A/84

[51] Int. Cl.[4] ..... B63H 9/04

[52] U.S. Cl. ..... 114/104; 114/106; 114/107

[58] Field of Search ..... 114/104, 102, 103, 105, 114/106, 107

[56] References Cited

U.S. PATENT DOCUMENTS

| | | | |
|---|---|---|---|
| 4,196,687 | 4/1980 | Newick | 114/106 |
| 4,449,467 | 5/1984 | Hild et al. | 114/103 |
| 4,573,424 | 3/1986 | Clausin | 114/106 |

FOREIGN PATENT DOCUMENTS

| | | | |
|---|---|---|---|
| 2934937 | 3/1981 | Fed. Rep. of Germany | 114/104 |
| 3211641 | 10/1983 | Fed. Rep. of Germany | 114/103 |
| 2557852 | 7/1985 | France | 114/106 |
| 2113636 | 8/1983 | United Kingdom | 114/104 |

*Primary Examiner*—Galen Barefoot
*Assistant Examiner*—Paul E. Salmon
*Attorney, Agent, or Firm*—Francis J. Bouda

[57] ABSTRACT

A sail maneuverable through the rotation of a rolling and unrolling structure to which the sail is anchored along an anchorage edge. A sheath surrounds the rolling structure and engages the sail at opposite sides along a coupling line spaced from the anchorage edge. The sheath and that intermediate portion of the sail between the coupling line and the anchorage edge being shaped so that when the sail is unrolled the sheath stretches out, retaining the intermediate portion within the end zones unstretched, causing the sail to take a bellying or fat-sail arrangement. At the beginning of rolling, the sail is pulled back into the intermediate portion and progressively also into the end zones, thereby assuming a flat-sail arrangement.

5 Claims, 3 Drawing Sheets

Fig.3
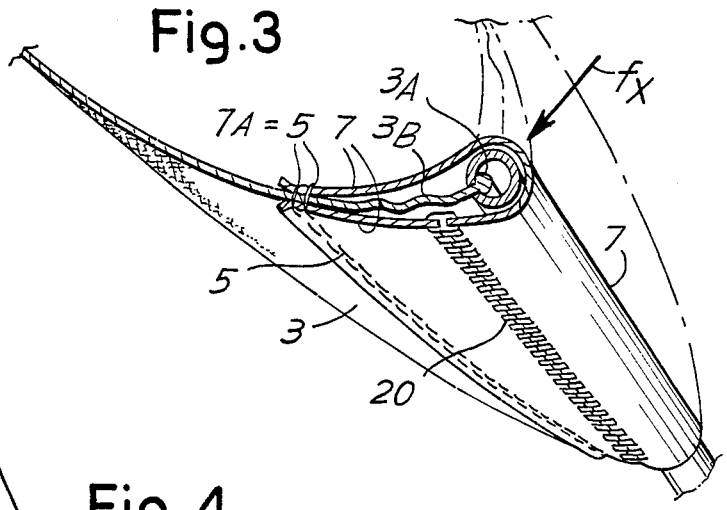
Fig. 4
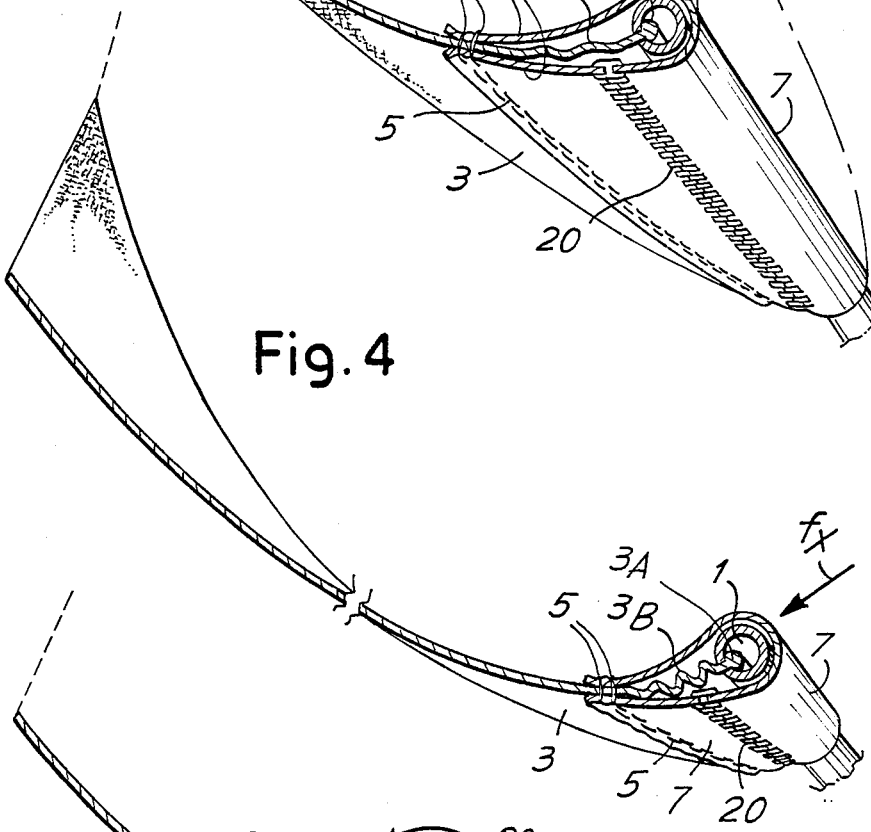
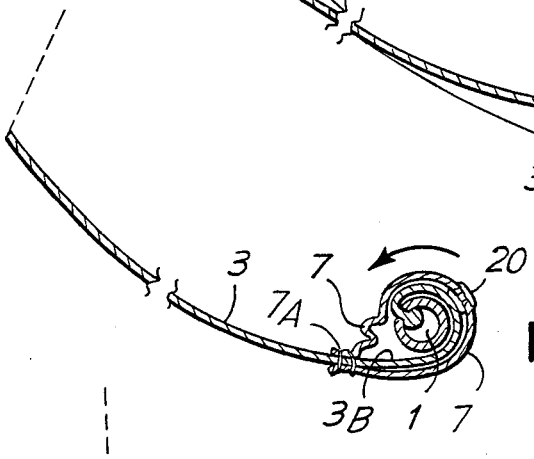
Fig.5
Fig. 6
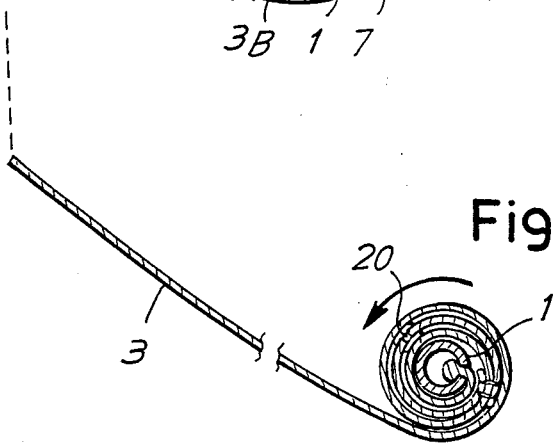

Fig. 7
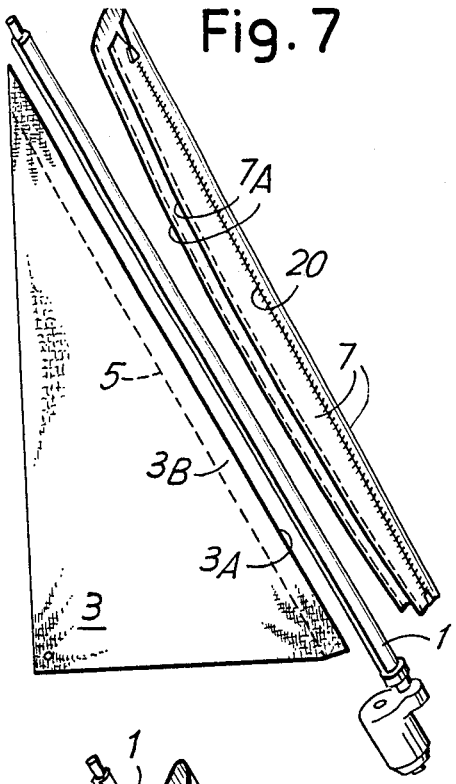
Fig. 8
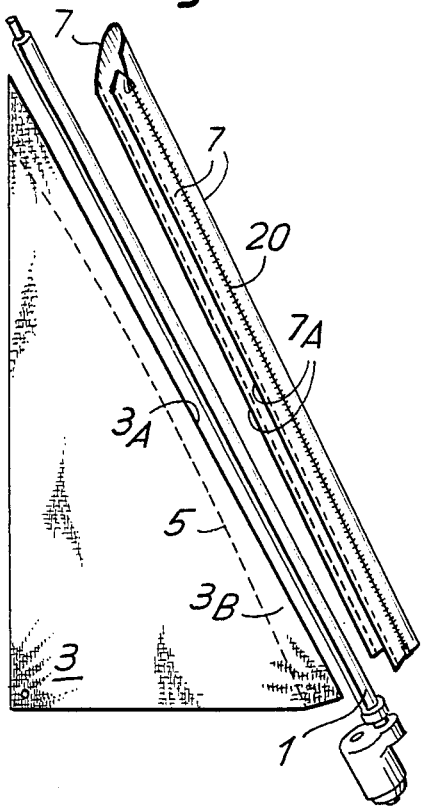
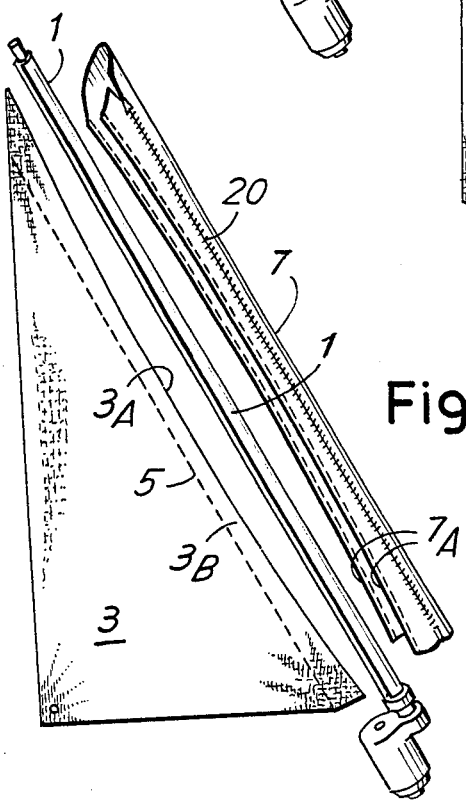
Fig. 9

SYSTEM FOR CHANGING THE OUTLINE OF A SAIL BEING WOUND UP TO REDUCE ITS AREA

It is known that in order to efficiently exploit the aeolian (i.e. wind) energy, the sail exposed to the wind should take a curved attitude with the concavity turned to the source direction of the wind which "fills the sail", so that, therefore, the sail will belly or become "fat". It is also known - according to recently developed techniques - to resort often to the reduction of the sail area and even to take the sail away from the wind action by rolling the sail over the straight structure for the mounting thereof, which structure is rotated about its axis to provide, in fact, the rolling. A flat, that is, a non-fat sail can be easily rolled up whereas a fat sail is not easily rolled up owing to the curvature it takes, thereby the rollable sail cannot be, in practice, a fat sail.

The invention has the purpose to reconcile the two requirements of fat-sail attitude and rolling capability, by taking into account that the maximum exploitation of the wind is obviously required, above all, with poor winds, and thus in conditions of the greatest extension of the sail for the maximum exploitation of the aeolian or wind energy, while the reduction of the sail area is carried out in presence of an excess of wind energy and, therefore, in the conditions under which the maximum exploitation of the wind is not important.

A further object of the invention is to accomplish, in combination with the above requirements, the best outline of the sail structure with the purpose of the sail penetration and the exploitation of an additional dynamic thrust effect, for a phenomenon similar to the one obtainable with a typical wing outline which is present in the birds wing and in the wing of the aircraft. The invention ensures also the obtainment of such additional object which is the more effective and appropriate the larger the cross-section of the sail mounting and rolling straight structure is; the larger section of this rolling structure ensures a correct rolling without torsional effects along the development of the straight structure, which is possible with a reduced section in respect to a considerable linear development like that of sails having remarkable dimensions.

Substantially, a sail according to the invention - maneuverable by rotation of a rolling and unrolling structure to which the sail is anchored along an anchorage edge - comprises a sheath (or an equivalent structure) which surrounds said rolling structure and engages the sail at opposite sides along a coupling line spaced from the anchorage edge. The shapings of said sheath and/or that of the intermediate portion of the sail which is comprised between said coupling line and said anchorage edge are such that - in unwound condition - the sail stretches out retaining said intermediate portion or strip with the end zones non stretched and causing the sail to take a fat-sail arrangement. At the beginning of the rolling, the sail is pulled back at first in the middle of the intermediate portion and progressively also into the end zones and thus the sail takes up a flat-sail attitude.

The rolling structure may be provided with relatively large section; the stretched condition of the sheath gives thus the sail a wing-like outline with dynamic effects of thrust and penetration.

The invention will be better understood by following the description and the accompanying drawing which shows a practical non limitative exemplification of the same invention. In the drawing:

FIGS. 3 and 4 shows a cross intermediate section and a cross section towards one of the ends, on lines III—III and IV—IV, respectively, of FIG. 1;

FIGS. 5 and 6 shows in section two stages of the rolling up that is the winding of the sail; and FIGS. 7, 8 and 9 show an exploded view of the sail of FIGS. 1 to 6, and two modified embodiments.

Figure 1:
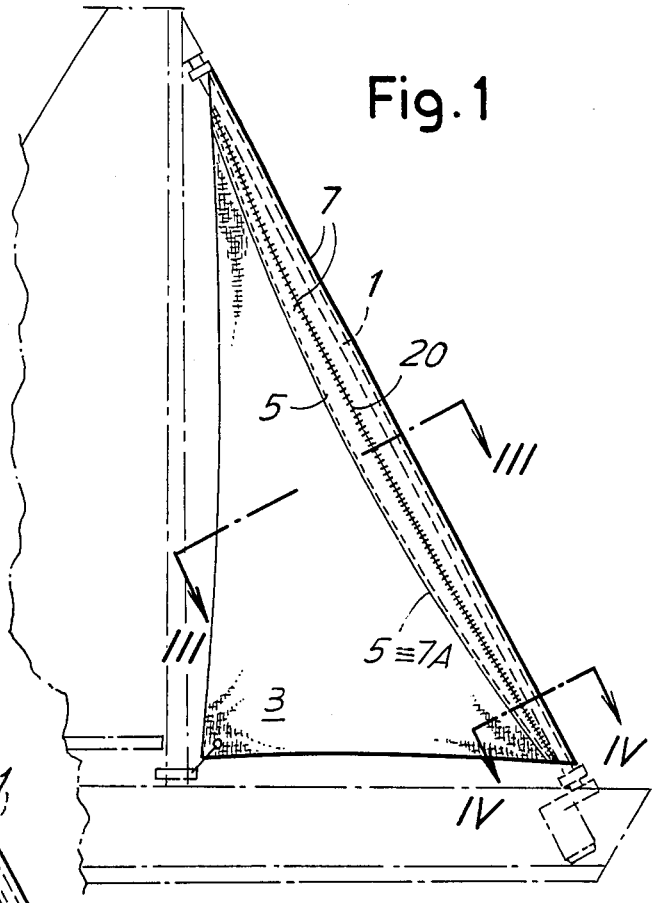
FIG. 1 shows a sail realized according to the invention, in stretched condition.
Figure 2:
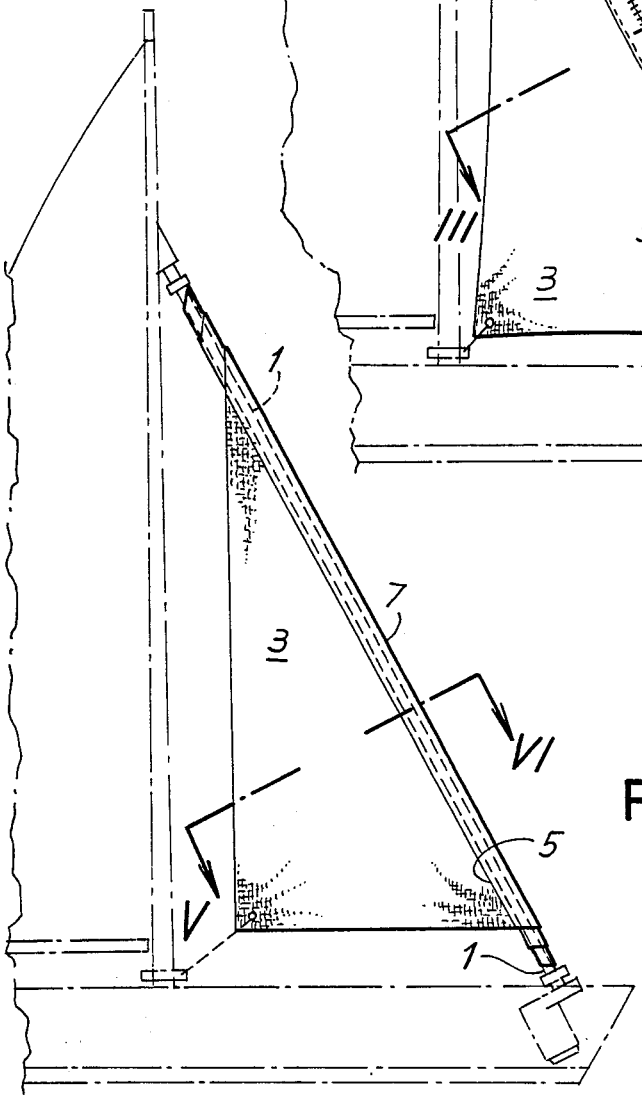
FIG. 2 shows the sail being partially rolled up.

According to what is illustrated in the accompanying drawing, numeral 1 indicates a rectilinear cylindrical and mostly tubular rolling structure along which the anchorage edge of the sail is anchored like along a stay; said structure is capable of being rotated to roll the sail and to unroll and thus to stretch it in order to reduce its area. Structures of this kind are known for motorized maneuvers on sails usually triangular. The rolling maneuver, on the other hand, is feasible and is correctly performed only in presence of flat sails, whereas fat sails under condition of maximum extension of the sail are not suitable for a reduction of the sail area by rolling, at least in conditions of correct rolling.

According to the invention and according to FIGS. 1 to 6, a sail 3 is provided whose shaping corresponds to that of a flat sail. The sail anchorage edge, indicated by 3A, is engaged to the structure 1 to achieve the possibility of a correct winding. Numeral 5 indicates a coupling line parallel to and spaced from the edge 3A, along which line 5, the edges 7A of a sheath 7 - especially made of sail fabric - are engaged to the sail 3. The sheath is arranged to partially wrap around the structure 1 and cover the zone 3B which is a strip or intermediate portion 3B of the sail is of uniform width comprised between the coupling line 5 and the edge 3A of the sail 3. The mounting of the sheath 7 is carried out so as to permit its removal or its longitudinal opening. The strip 3B remains included within the sheath. The sheath 7 is dimensioned, in the intermediate cross sections, in such a way that the dimensions of the sheath section may correspond to the transverse dimensions of the strip 3B combined with the structure 1, thereby said strip 3B of sail 3 results, in the central zones, almost stretched inside the sheath 7, as indicated in FIG. 3, when the sail is affected by the wind. In sections gradually closer to the ends of the sheath 7, as in the sectional view of FIG. 4, the same sheath 7 has cross-section dimensions gradually smaller, that is, with shorter wings, since the edges 7A are arcuate; accordingly, the strip 3B of sail 3, in the zones that are closer to the ends, does not reach to stretch, but it remains slackened, as shown by way of example in the drawing, while the two wings of sheath 7 remain stretched.

As a consequence of this arrangement - schematically shown for a better understanding - the sail 3, 3B having the configuration of a stretched sail, cannot result stretched in its attitude of maximum extension but, owing to the stretched sheath 7, may extend over its maximum dimension only in the central zone, whereas due to the stretching of the sheath 7, the sail cannot become stretched in the zones gradually closer to the ends of the edge 3A along the structure 1. This provides the possibility of obtaining a fat-sail condition when the sail 3, completely unwound from structure 1, is put in tension together with the fabric of the sheath 7 anchored through the edges 7A along the line 5. In this attitude the sail permits the maximum exploitation of the wind energy by behaving like a fat sail. Moreover, the two branches of the sheath 7, which extend in stretched condition between the structure 1 and the connection line 5 of the edges 7A of the sail 3, make up, with the partial cylindrical outline of structure 1 (on which the sheath 7 centrally lies), a shaping having a wing outline section resembling the typical outline of the bird wing section. A thrust dynamic effect is thus introduced into the sail, while a greater penetration effect in the aeolian current is obtained when this affects the sail in a direction having at least a component according to arrow fX of FIGS. 3 and 4.

When the sail area is to be reduced and thus the sail 3 begins to be rolled on structure 1, the same structure 1, at the beginning of the rotation maneuver, calls back the strip 3B of sail 3, causing a winding of such strip by constant amounts through the whole extension of structure. Thus the slackened parts of said strip 3B towards the ends are progressively reduced, while in the central zone a recall is effected, from the very beginning, of sail 3 along the line 5. This rolling up of the strip 3B has thus effect, initially, only in the central zone and then progressively, also towards the ends, until the end zones of strip 3B are stretched. At that point, the line 5 takes, practically, a rectilinear arrangement, rather than a curved arrangement as it was allowed by the sheath 7 in the conditions of greater or maximum extension of sail 3. As the rolling up goes on, the sail 3 reaches and keeps its proper flat attitude and then winds up correctly on structure 1. The fabric of sheath 7 will progressively become wrapped within the coils of sail 3 rolled up during the progressive formation of coils of the sail 3 above and outside of the line 5.

Obviously, the maximum stretching attitude of sail 3 will result arcuate like a fat sail depending on the shaping of the wings of sheath 7 and on the position of line 5, also with possible modifications in respect to the geometrical condition, stated above, of the line 5 being straight and parallel to the anchorage edge 3A, and of the edges 7A of sheath 7 being curved. The curvature of the edges 7A (or the curvature of other outlines functionally equivalent) will possibly be determined in relation to the fat-sail attitude which is to be imposed to the sail 3 in connection with the completely stretched sheath 7.

It should be noted that the sail area made up of components 3 and 7 in the arrangement of maximum extension and, thus, of fat sail, takes the wing outline, as indicated above, in both the dispositions that a sail assumes when veering and, accordingly, when the sail concavity reverses to appear on the face opposite to that previously concave, as can be seen in FIG. 3, for comparison between the part shown with solid line and the part shown with dash-dot line.

In FIGS. 1 and 7 the strip 3B between the anchorage edge 3A and the coupling line 5, is provided with substantially constant width and the edges 7B of the sheath, which are mounted on the sail 3 along the coupling line 5, are, in this case, convex, so that the transverse dimensions of said sheath are greater at the center than towards the ends. Alternatively, as can be seen in FIG. 8, the strip 3B between the anchorage edge 3A and the coupling line 5 may be of lesser width at the center than towards the ends, and the sheath 7 has, in this case, substantially constant dimensions. As a further alternative, according to FIG. 9, the strip 3B between the anchorage edge 3A and the coupling line 5 may be of lesser width at the center than towards the ends, and the sheath 7 has, in this case, transverse dimensions greater at the ends center than towards the center. These solutions may integrate with each other.

The sheath 7 can be opened along a closure means 20 to permit the removal of the sail 3 which may be thus pulled out along the structure 1 or otherwise disengaged from it.

It is understood that the drawing shows an exemplification given only as a practical demonstration of the invention, as this invention may vary in the forms and dispositions without nevertheless coming out from the ambit of the idea on which the invention is based. The possible presence of reference numbers in the attached claims has the purpose to facilitate the reading of the claims, reference being made to the description and drawing, and does not limit the ambit of the protection pointed out by the claims.

I claim:

1. A sail having a forward edge and constructed for mounting on a roller-mast said mast having a forward edge and a center, and having a slot to receive and removably hold therein the forward edge of the sail, said sail including a body-portion having a coupling line, a sheath to surround the forward edge of said mast said sheath having trailing edges secured to the body of said sail along said coupling line in spaced relation to the forward edge thereof, the distance of the trailing edges of said sheath from the center of said mast being less than the distance of the forward edge of said sail from the coupling line to the center of said mast when said sail is unfurled and tensioned against the mast, whereby the portion of the sail between the forward edge and the coupling line is relieved of tension while the sheath carries the sail between the mast and the trailing edges.

2. The sail of claim 1 wherein the forward edge of the sail can be wound up around the mast within said sheath-portion, continued winding of the mast drawing the fastening portion of the sail and sheath around the mast.

3. The sail of claim 1 wherein the sail between the forward edge and the coupling line is of substantially constant width and the trailing edges of the sheath are convex, whereby the transverse dimensions of the sheath are greater at the center than toward the end.

4. The sail of claim 1 wherein the sail between the forward edge and the coupling line is of lesser width at the center than toward the ends, and the trailing edges of the sheath are straight lines.

5. The sail of claim 1 wherein the sail between the forward edge and the coupling line is of lesser width at the center than toward the ends and the sheath has greater transverse dimension at the ends than at the center.

* * * * *